US005817257A

United States Patent [19]

Kenny et al.

[11] Patent Number: 5,817,257

[45] Date of Patent: Oct. 6, 1998

[54] FUEL METERING SYSTEM

[75] Inventors: Brian Kenny, Tralee; Gerard Murphy, Clonakilty, both of Ireland

[73] Assignee: Barcarole Limited, Cork, Ireland

[21] Appl. No.: 611,807

[22] Filed: Mar. 6, 1996

[30] Foreign Application Priority Data

Jan. 15, 1996 [IE] Ireland ..... S960029

[51] Int. Cl.[6] ..... F02M 17/04

[52] U.S. Cl. ..... 261/69.2; 261/DIG. 68

[58] Field of Search ..... 261/69.2, DIG. 68

[56] References Cited

U.S. PATENT DOCUMENTS

| | | | |
|---|---|---|---|
| 2,277,930 | 3/1942 | Mock et al. | 261/69.2 |
| 2,316,300 | 4/1943 | Udale | 261/69.2 |
| 2,316,327 | 4/1943 | Garretson | 261/69.2 |
| 2,392,055 | 1/1946 | Mennesson | 261/69.2 |
| 2,400,369 | 5/1946 | Partington | 261/69.2 |
| 2,445,846 | 7/1948 | Bartod et al. | 261/69.2 |
| 2,447,791 | 8/1948 | Bartod | 261/69.2 |
| 2,448,131 | 8/1948 | Williams, Jr. et al. | 261/69.2 |
| 2,717,827 | 9/1955 | Best | 261/69.2 |
| 4,359,031 | 11/1982 | Stoltman et al. | 261/69.2 |
| 4,787,356 | 11/1988 | Rosgen et al. | 261/69.2 |

*Primary Examiner*—Tim R. Miles
*Attorney, Agent, or Firm*—Harness, Dickey & Pierce, P.L.C.

[57] ABSTRACT

A fuel metering system comprises a throttle body 1 having an air passage 2, a throttle valve 6 mounted in the air passage, and at least one port 9–11, 13 opening into the air passage which is responsive to engine manifold vacuum to provide a negative pressure signal at a connector 12 or 14. The system also includes a repeater (FIG. 2) remote from the throttle body having a fuel inlet, a fuel outlet for delivery of fuel to the engine, and means for metering the delivery of fuel as a function of the negative pressure signal.

4 Claims, 2 Drawing Sheets

FUEL METERING SYSTEM

This invention relates to a fuel metering system, and in particular to a mechanically operated fuel system which uses signals produced in a throttle body to control the delivery of fuel at a point remote from the throttle body. The invention relates particularly but not exclusively to 2 stroke engines of low emissions type currently under development worldwide.

According to the present invention there is provided a fuel metering system comprising a throttle body having an air passage, a throttle valve mounted in the air passage, and at least one port opening into the air passage which is responsive to engine manifold vacuum to provide a negative pressure signal, the system further including a repeater remote from the throttle body having a fuel inlet, a fuel outlet for delivery of fuel to the engine, and means for metering the delivery of fuel as a function of the negative pressure signal.

The fuel may be delivered typically to any location on an engine from which it can gain access to the combustion chamber, and is supplied in such quantity as to form a combustible charge with the air entering the engine through the throttle body.

Figure 1:
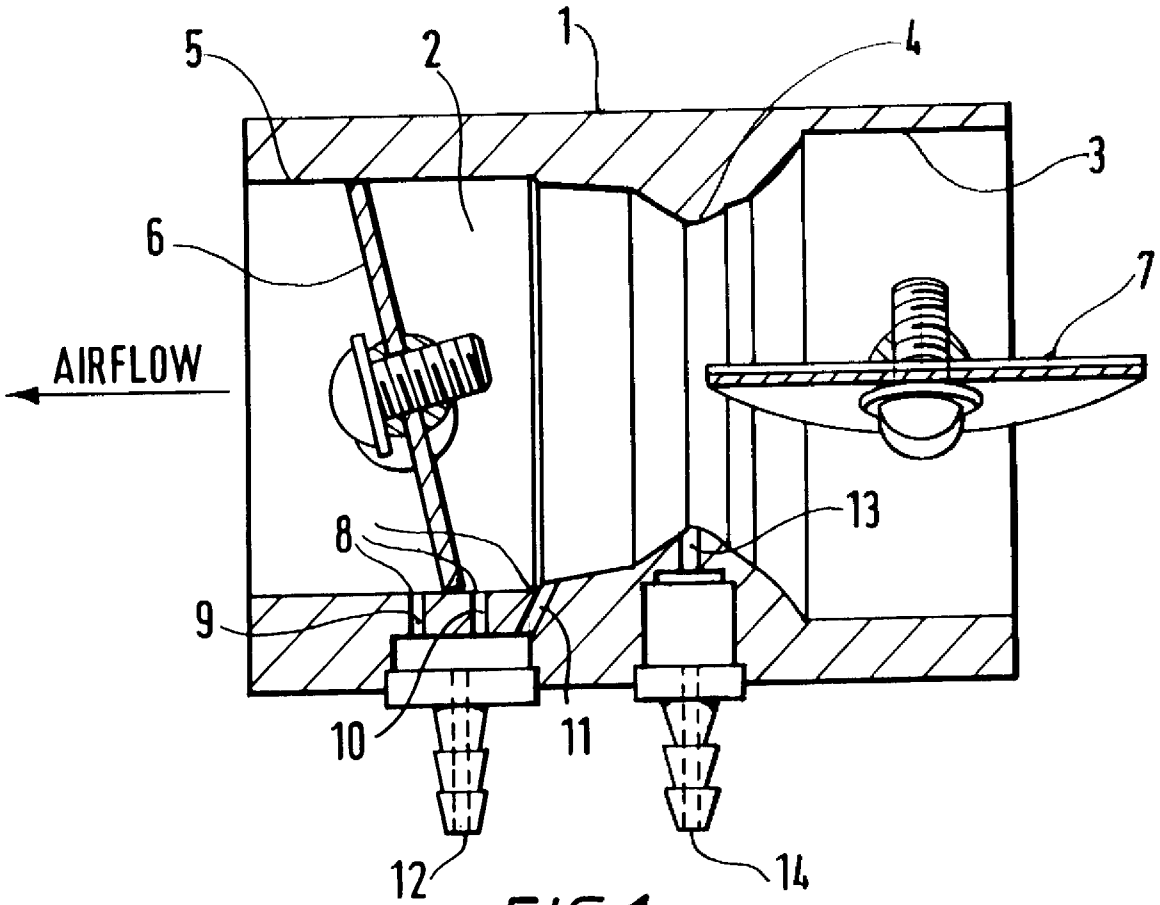
Figure 2:
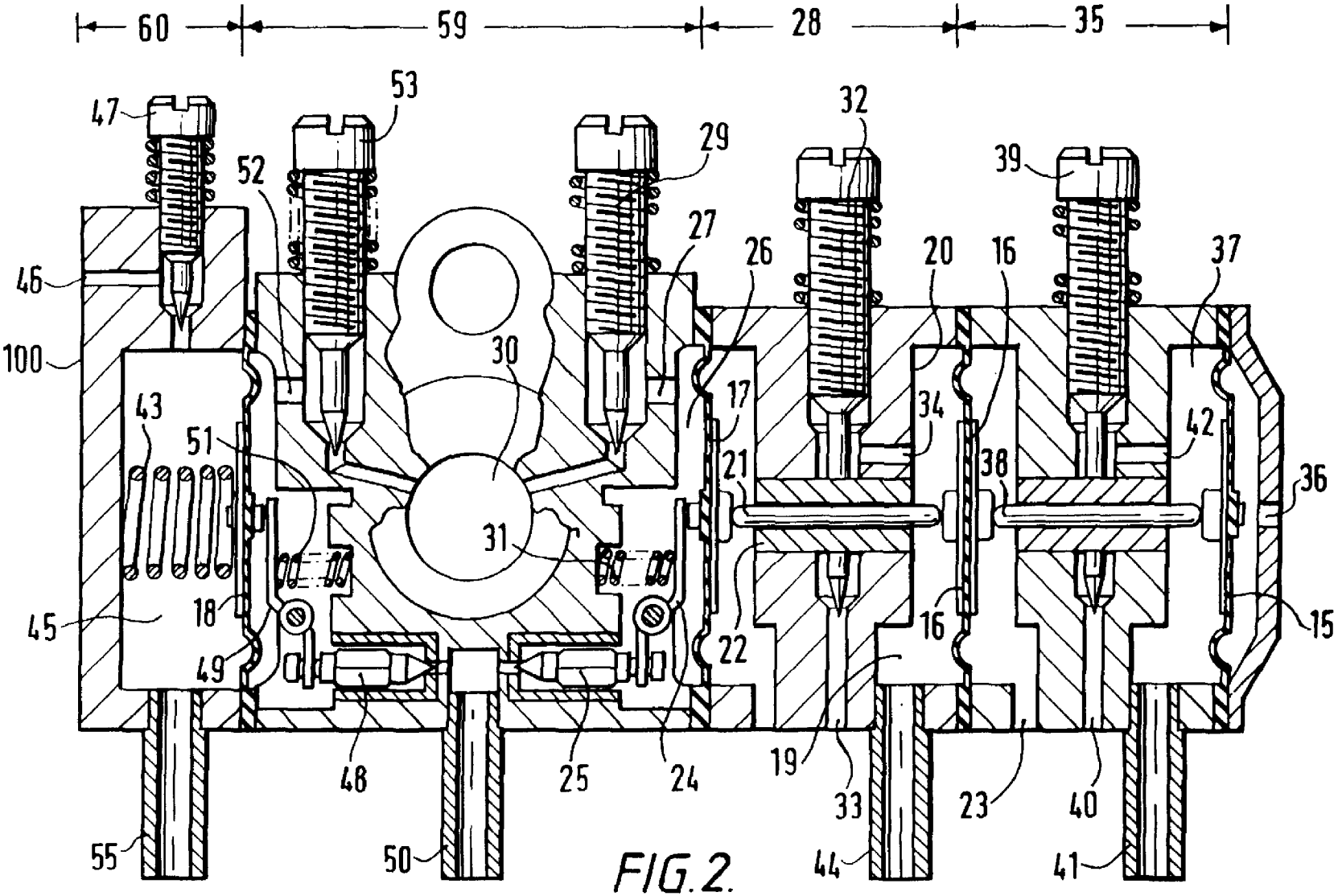

An embodiment of the invention will now be described, by way of example, with reference to the accompanying drawings, in which:

FIG. 1 is a cross-sectional view of a throttle body forming one part of the a fuel metering system according to the embodiment, and FIG. 2 is a cross-sectional view of a repeater forming the other part of the fuel metering system of the embodiment.

Referring first to FIG. 1, the throttle body 1 has an air passage 2 through it of which successive sections in the direction of air flow (left to right in FIG. 1) are an air entry or air horn 3, a venturi 4 and a throttle bore 5. A throttle valve 6 is rotatably mounted in conventional manner in the throttle bore 5 and a choke valve 7 is likewise rotatably mounted in the air horn 3 for closing the latter when cold starting.

Also within the body 1 is a low speed system 8 comprising a series of ports 9, 10, 11 which open into the throttle bore 5 and all lead to a common external connector 12. When the throttle valve 6 is fully shut (as seen in FIG. 1) the port 9 opens into the throttle bore 5 downstream of the throttle valve 6 whereas the other ports 10, 11 open into the throttle bore 5 upstream of the throttle valve 6. A high speed system is also provided in the body 1 by a port 13 which opens into the venturi 4 substantially upstream of the ports 8 and leads to a further external connector 14.

In use the right hand end (as seen in FIG. 1) of the throttle body 1 is bolted to the engine intake manifold and airflow into the engine is controlled by opening or closing the throttle valve 6. When the throttle valve 6 is closed with the engine idling, engine manifold vacuum acts on the primary port 9 to produce a negative pressure signal at connector 12.

As the throttle valve 6 is progressively opened the secondary port (or 2nd bypass) 10 is exposed to the manifold vacuum and the signal at the connector 12 is augmented. Later, upon further opening the throttle valve 6, the progression port (or 3rd bypass) 11 is exposed to manifold vacuum and this further increases is the negative pressure signal at the connector 12. By correct positioning and sizing of the ports 9, 10 and 11 a progressive increase in negative pressure occurs at the connector 12 which reflects increasing engine airflow and is at least approximately proportional to it.

In this way a negative pressure signal is generated in the throttle body 1 at the connector 12. This negative pressure signal is connected via a flexible air pipe (not shown) to the repeater, FIG. 2.

In a similar way, as airflow increases through the throttle body 1 as the throttle valve 6 opens, the venturi 4 becomes active and begins to develop a negative pressure area over the high speed port 13. This signal increases with increasing airflow and appears at connector 14. This signal at 14 is connected to the repeater via a further flexible air pipe. As will be described, the effect of the two negative pressure signals at the connectors 12 and 14 is combined at the repeater to provide a mechanical signal which accurately reflects mass airflow into the engine. The repeater responds by delivering fuel in proportion to engine demands.

The choke valve 7 can be closed for cold starting. Closure causes high manifold negative pressures to be applied to the low speed 8 and high speed 13 ports. The resulting augmented negative pressure signals produce enriched starting fuel flows from the repeater, enabling a cold engine to start.

Turning now to FIG. 2, the repeater comprises a housing 100 whose interior is divided into four sections by a plurality of diaphragms 15, 16, 17 and 18 extending transversely across the interior of, and spaced at intervals along the longitudinal axis of, the housing 100. The four sections are an idle/low speed section 28 defined between the low speed and fuel diaphragms 16 and 17 respectively, a high speed section 35 defined between the high speed and low speed diaphragms 15 and 16 respectively, an idle governor section 60 defined between the governor diaphragm 18 and the left hand end of the housing 100, and a fuel delivery section 59 defined between the fuel and governor diaphragms 17 and 18 respectively.

The idle/low speed section 28 has a connector 44 which is connected via an air pipe to the connector 12 on the throttle body 1, the high speed section 35 has a connector 41 which is connected via an air pipe to the connector 14 on the throttle body, the fuel delivery section 59 has a connector 50 for receiving pressurised fuel from a vapour separator (not shown), and the governor section 60 has a connector 55 for connection to the engine manifold. In use the repeater housing 100 is bolted to the engine with a fuel delivery passage 30 in communication with the engine fuel inlet.

Starting first with the idle/low speed section 28, this includes a pneumatically sealed chamber 19 defined on one side by the low speed diaphragm 16 and on the other side by an internal wall 20 extending transversely across the housing 100. In use the chamber 19 is connected through the connector 44 to the connector 12 on the throttle body 1. A pushrod 21 extends axially of the housing 100 from the diaphragm 16 to the fuel diaphragm 17, passing through a precision leakproof bearing 22 in the wall 20. The side of the diaphragm 16 opposite the chamber 19 is vented to atmosphere via an aperture 23 in the side of the housing 100.

The negative pressure produced in the chamber 19 from the connector 12 on the throttle body 1 produces a pressure differential across the low speed diaphragm 16. This pressure differential produces a force on the diaphragm 16 which moves the pushrod 21 to the left, as seen in FIG. 2, the amount of movement being the greater the greater the pressure differential across the diaphragm 16.

Movement of the pushrod 21 in turn moves the fuel diaphragm 17 to the left. This acts on a lever 24 which moves a fuel metering needle 25 off its seat admitting pressurised fuel from connector 50 into the fuel chamber 26. This fuel leaves the chamber 26 via a port 27 and an adjustment screw 29 and enters the fuel delivery passage 30 for delivery to the engine. A spring 31 keeps the fuel metering needle 25 closed when the engine is stopped and no negative signals are available. The idle/low speed section 28 is intended to supply fuel at least approximately proportionally to negative signal values from the throttle body connector 12.

An adjustment screw 32 is used to bleed air from an air bleed orifice 33 into the negative pressure chamber 19 to reduce fuel flow as desired. In practice the adjustment may be set in a constantly open position so that adjustment toward the closed direction causes greater negative signal and additional fuel delivery. Conversely further opening of the adjustment will produce less negative pressure signal thereby reducing fuel flow. Air enters through the port 33 and after adjustment by the screw 32 enters the negative pressure air chamber 19 via a port 34. Thus during operation there is a constant flow of air from inlet port 33 to the low speed ports 9 to 11 in the throttle body 1.

Turning now to the high speed section 35, the construction and operation of the high speed section 35 is essentially the same as that of the idle/low speed section 28 and will not be described in detail. The main difference is that it operates in response to the high speed negative pressure signal from the throttle body connector 14 instead of in response to the low speed signal from the throttle body connector 12.

The negative pressure produced in a chamber 37 from the throttle body connector 14, which is connected to the connector 41 on the repeater housing 100, produces a pressure differential across the high speed diaphragm 15 (the opposite side of the diaphragm 15 is vented to atmosphere via an aperture 36). In response to this pressure differential the high speed diaphragm 15 is moved to the left and pushes a pushrod 38 to the left with it. The amount of movement of the pushrod 38 is, as in the case of the pushrod 21, the greater the greater the pressure differential across the diaphragm 15.

The pushrod 38 bears on and moves the low speed diaphragm 16 to the left, and this movement of the low speed diaphragm 16 is transmitted on to the fuel diaphragm 17 by the pushrod 21 to operate the fuel metering needle 25 in the manner already described. The high speed section 35 is intended to supply fuel at least approximately proportionally to negative signal values from the throttle body connector 14.

Again an adjustment screw 39 is used to bleed air from an air bleed orifice 40 into the negative pressure chamber 37 via a port 42, to allow adjustment of fuel flow by air bleeding. When the engine is idling, the high speed section 35 is substantially inactive.

It will be seen that the movement of the high and low speed diaphragms 15 and 16 is cumulative at the fuel diaphragm 17, so that the low speed and high speed negative pressure signals are in effect combined into a single mechanical signal or metering force, resulting in delivery to the fuel delivery passage 30 of a required fuel flow via the fuel control needle 25.

However, an engine running stratified at idle/part throttle may require special idle speed control measures and for that purpose an idle governor is used.

The connector 55 is connected to the engine manifold from which a high negative pressure is available in the governor chamber 45 when the engine is idling with the throttle closed. This negative pressure acts on the left hand side of the governor diaphragm 18, compressing a spring 43 located between the governor diaphragm 18 and the left hand of the housing 100. The degree of compression of the spring 43 can be controlled by allowing air to bleed into the chamber 45 from an air bleed orifice 46 via an adjustment screw 47.

When the engine idle slows for any reason, such as a light load, engine rpm falls and so does manifold negative pressure. The spring 43 then pushes the diaphragm 18 to the right, opening a fuel metering valve 48 via a lever 49 against the bias of a compression spring 51 tending to keep the valve 48 closed. The fall in engine rpm therefore results in an increased fuel flow to the engine via a fuel port 52 and an adjustment screw 53. This increases combustion pressure and engine rpm stabilises.

Conversely, should engine rpm increase, manifold vacuum will be greater and the diaphragm 18 will exert more force on the spring 43. The diaphragm 18 will therefore move away from the lever 49 and the spring 51 will reduce fuel flow by closing fuel metering inlet valve 48 somewhat. In this way an increase in engine rpm produces a decreased fuel flow causing the engine to slow. When idling, the engine cycles through this rich lean "loop" thereby maintaining a steady idling speed.

It must be pointed out that the idle governor proposed is for a "stratified" engine. Stratified operation occurs when a combustible mixture is maintained close to the spark plug where it may be combusted, while elsewhere in the cylinder/combustion chamber the mixture is too lean to burn. Stratified operation, if achievable, allows engine operation much leaner than stoichiometric offering greater fuel economy and reduced co and HC exhaust emissions.

In a conventional engine which is idling with its idle fuel/air mixture adjusted half way between rich fall off (rpm loss due to over rich operation) and lean fall off (rpm loss due to over lean operation), the addition of extra fuel results in a fall in rpm. In a stratified engine the opposite is the case. This calls for an idle regulation system in which the addition of extra fuel causes an increase in engine rpm. In the stratified engine there is excess oxygen in the combustion chamber so that the addition of extra fuel increases explosive force and rpm rises. Reduction in fuel conversely leaves more oxygen unreacted, and explosive force reduces and rpm falls. The idle governor inverts the negative pressure manifold signals to achieve stable idle operation.

Thus the repeater is capable of supplying fuel to a conventional unstratified engine using the low and high speed sections 28 and 35 and the right hand side of the fuel delivery section 59 via fuel metering valve 25. For a stratified engine, the unconventional idle regulatory fuel demands can be met by the idle governor section 60 and the left hand side of the fuel delivery section 59 via fuel metering valve 48.

We claim:

1. A fuel metering system comprising a throttle body including:

an air passage;

a throttle valve mounted in the air passage;

at least one low speed port located in the region of the throttle valve; and at least one high speed port located upstream of the low speed port;

each of the low and high speed ports opening into the air passage and being responsive to engine manifold vacuum to provide a respective progressively increasing negative pressure signal as the throttle valve is opened;

the system further comprising a repeater remote from the throttle body, including:

a housing containing first and second chambers;

first and second diaphragms forming one wall of the first and second chambers respectively;

means supplying each negative pressure signal from the throttle body to a respective one of the first and second chambers so as to cause movement of the respective diaphragm as a function of the magnitude of the respective negative pressure signal;

means mechanically connecting the first and second diaphragms so that movement of the second diaphragm is in response to the combined effect of both negative pressure signals; and a fuel chamber in the housing having a fuel inlet, a fuel outlet and a metering valve for controlling the flow of fuel from the fuel inlet to the fuel outlet, the metering valve being responsive to the movement of the second diaphragm.

2. A fuel metering system according to claim 1, wherein the first and second diaphragms are connected by a first pushrod, wherein the fuel chamber has a third diaphragm forming one wall, wherein a second pushrod connects the second diaphragm to the third diaphragm, and wherein movement of the third diaphragm controls the degree of opening of the metering valve.

3. A fuel metering system according to claim 1, wherein the repeater housing has a third chamber connectable to the engine manifold and having a fourth diaphragm as one wall, the fourth diaphragm also constituting a further wall of the fuel chamber and being movable in response to changes in manifold pressure, and wherein the fuel chamber includes a further metering valve for controlling the flow of fuel from the fuel inlet to the fuel outlet independently of the first metering valve, the further metering valve being responsive to movement of the fourth diaphragm.

4. A fuel metering system according to claim 1, wherein the throttle body comprises a plurality of low speed ports providing a single negative pressure signal.

* * * * *